US009282779B2

(12) United States Patent
Domenico

(10) Patent No.: US 9,282,779 B2
(45) **Date of Patent: *Mar. 15, 2016**

(54) SKYDIVING HELMET WITH ANTI-FOG SYSTEM

(75) Inventor: Anthony J. Domenico, Menifee, CA (US)

(73) Assignee: SQUARE ONE PARACHUTES, INC., Murrieta, CA (US)

( * ) Notice: Subject to any disclaimer, the term of this patent is extended or adjusted under 35 U.S.C. 154(b) by 113 days.

This patent is subject to a terminal disclaimer.

(21) Appl. No.: 13/281,759

(22) Filed: Oct. 26, 2011

(65) Prior Publication Data

US 2013/0104298 A1 May 2, 2013

(51) Int. Cl.

| | |
|---|---|
| ***A42B 3/00*** | (2006.01) |
| ***F41H 1/04*** | (2006.01) |
| ***A61F 9/02*** | (2006.01) |
| ***A42B 3/24*** | (2006.01) |
| ***A42B 3/28*** | (2006.01) |

(52) U.S. Cl.
CPC . *A42B 3/24* (2013.01); *A42B 3/283* (2013.01); *Y10T 29/49826* (2015.01)

(58) Field of Classification Search
CPC ..... A42B 3/00; A42B 3/24; A42B 3/28; A42B 3/0493; A42B 3/281; A42B 3/283; A42B 3/163; A63B 71/10
USPC ..... 2/6.1, 6.3, 15, 410, 425, 427, 429–431, 2/435–439
See application file for complete search history.

(56) References Cited

U.S. PATENT DOCUMENTS

| | | | | | |
|---|---|---|---|---|---|
| 2,638,592 | A * | 5/1953 | Olson | 2/8.7 | |
| 3,838,466 | A * | 10/1974 | Poirier | 2/10 | |
| 4,498,202 | A * | 2/1985 | Yamamoto | 2/424 | |
| 4,538,303 | A * | 9/1985 | Schnitzler | 2/424 | |
| 4,667,348 | A * | 5/1987 | Sundahl | 2/410 | |
| 4,731,885 | A * | 3/1988 | Nava | 2/424 | |
| 4,764,990 | A * | 8/1988 | Markert | 2/429 | |
| 5,058,212 | A * | 10/1991 | Kamata | 2/424 | |
| 5,212,843 | A * | 5/1993 | Kamata | A42B 3/06 | 2/171.3 |
| 5,388,277 | A * | 2/1995 | Taniuchi | 2/422 | |
| 5,394,566 | A * | 3/1995 | Hong | 2/424 | |
| 5,694,650 | A * | 12/1997 | Hong | 2/424 | |
| 6,425,143 | B1 * | 7/2002 | Benedict et al. | 2/424 | |
| 6,748,607 | B1 * | 6/2004 | Hong | 2/422 | |
| 6,896,366 | B2 * | 5/2005 | Rice et al. | 351/62 | |
| 7,716,754 | B1 * | 5/2010 | Ross | 2/424 | |
| 8,176,575 | B2 * | 5/2012 | Tsuzuki | A42B 3/24 | 2/171.3 |
| 2008/0134415 | A1 * | 6/2008 | Pierce | 2/410 | |
| 2010/0037372 | A1 * | 2/2010 | Tsuzuki | 2/424 | |
| 2010/0132703 | A1 * | 6/2010 | Ivory | 128/201.24 | |
| 2014/0189941 | A1 * | 7/2014 | Domenico | 2/424 | |

FOREIGN PATENT DOCUMENTS

| | | | | |
|---|---|---|---|---|
| EP | 1153551 A2 * | 11/2001 | | A42B 3/28 |
| FR | 2564709 A1 * | 11/1985 | | A42B 3/24 |
| GB | 2184640 A * | 7/1987 | | A42B 3/24 |

* cited by examiner

*Primary Examiner* — Alissa L Hoey
*Assistant Examiner* — Jameson Collier
(74) *Attorney, Agent, or Firm* — Nydegger & Associates

(57) ABSTRACT

A skydiving helmet includes a lens for protecting the face of a skydiver during a skydiving event. An air-intake hole is formed on the helmet, and an airflow deflector plate is positioned against the air-intake hole. Thus, the deflector plate directs air over the inside surface of the lens to prevent fog from forming on this surface during a skydiving event.

16 Claims, 1 Drawing Sheet

SKYDIVING HELMET WITH ANTI-FOG SYSTEM

FIELD OF THE INVENTION

The present invention pertains generally to protective headgear. More particularly, the present invention pertains to skydiving helmets. The present invention is particularly, but not exclusively useful as a skydiving helmet having an air-intake for directing air into the helmet, and over the inside surface of the helmet's lens, to prevent the lens from fogging-up during a skydiving event.

BACKGROUND OF THE INVENTION

As a sport, skydiving is at once exhilarating and potentially dangerous. Suffice it to say, the sport of skydiving requires a "jumper" (skydiver) to be keenly aware of his/her situation at all times during a skydive. This is particularly so when many jumpers are simultaneously involved in a same skydiving event. Specifically, in such circumstances there is always the ever-present potential for a midair collision. For instance, a popular activity of experienced skydivers is to "join-up", and hold hands during a skydive. As an aside, the present world record for such an endeavor has involved in excess of four hundred jumpers. In this particular example, and in other such events, situational awareness for each jumper is of the utmost importance. Moreover, situational awareness can be just as important when there are only a few jumpers, or even when there is but a single jumper.

It is not uncommon for skydivers to exit their aircraft at altitudes as great as 10,000 feet. For experienced jumpers with special equipment, altitudes around 20,000 ft. are quite common place. In the event, such a jump may last for only about 90 seconds. During this time, as the skydiver falls through the air, the outside air temperature may change by as much as 50° F. A consequence here is that the lenses being used to protect the eyes of a jumper during a skydiving event may become fogged-up.

With the above in mind, there are two considerations that are of paramount importance for the design of a skydiving helmet. First, it is necessary that the helmet protect both the head, and the face, of a skydiver against the possibility of a midair collision with another skydiver. Second, the helmet must be designed so that the lens is prevented from fogging up, in order for a jumper to acquire the situational awareness that is necessary for a successful skydive.

In light of the above, it is an object of the present invention to provide a jumper with the ability to have continuous situational awareness during a skydive. Another object of the present invention is to provide a skydiving helmet that protects the head and face of a jumper during a skydiving event. Still another object of the present invention is to provide a skydiving helmet that is easy to use, is relatively simple to manufacture, and is comparatively cost effective.

SUMMARY OF THE INVENTION

In accordance with the present invention, a skydiving helmet is provided with a feature that prevents fog from forming on the inside surface of the helmet lens that covers the face of a skydiver. Specifically, while the helmet and its lens encapsulate the head of a skydiver during a jump, air is directed into the helmet through an air-intake hole. This air is then directed onto the inside surface of the lens to prevent fogging. An exhaust vent is also provided for the helmet which effectively directs this airflow from the air-intake hole over the entire inside surface of the lens.

Structurally, the skydiving helmet of the present invention includes a helmet body that is formed with an opening. A rim of the helmet body borders this opening and the rim is dimensioned so that it surrounds the face of a skydiver. Within this structure, the rim of the helmet has a forehead portion and a chin portion. Also, the chin portion of the helmet rim is formed with the air-intake hole.

A transparent lens, preferably made of a clear or tinted plastic, is provided to cover the opening of the helmet body. In detail, a pair of swivel mounts is positioned to hold the lens on the helmet body. Specifically, these swivel mounts are positioned on opposite sides of the helmet body, across the opening from each other, and they are each located between the forehead portion and the chin portion of the helmet rim. Further, each swivel mount includes a release button that selectively holds the lens in place over the opening. When simultaneously depressed, the release buttons allow the lens to be lifted from the opening to allow for access through the opening into the helmet body. As an additional feature, the lens itself is configured for a so-called "quick connect" for placement of the lens on the helmet.

It is an important aspect of the present invention that, when the lens covers the opening on the helmet body, an exhaust vent is established between the forehead portion of the helmet body and the inside surface of the lens. To do this, a separation distance of approximately ⅛ inch is provided between the forehead portion of the helmet rim and the inside surface of the lens. Specifically, this separation distance establishes the exhaust vent. Importantly, the exhaust vent extends across the entire forehead portion of the helmet rim, and extends through an arc of approximately 100°. This arc is centered on the air-intake hole in the chin portion of the helmet rim.

In addition to the helmet body and the lens, the present invention also includes an airflow deflector plate that is positioned inside the helmet body against the air-intake hole. Structurally, this airflow deflector plate includes a base member that is formed with a scoop. When positioned against the air-intake hole, the scoop of the airflow deflector plate effectively divides the air-intake hole into an upper air-intake vent, and a lower air-intake vent. Functionally, while the lower air-intake vent provides breathing air for the skydiver, it is the upper air-intake vent that provides the fog prevention feature of the present invention.

As indicated above, the airflow over the inside surface of the lens that prevents a fog-up on the lens starts at the air-intake hole and goes through the upper air-intake vent of the airflow deflector plate. From the airflow deflector plate, this air then fans out through an arc over the inside surface of the lens until it exits from the helmet through the exhaust vent. To assist with this fanning out, the airflow deflector plate includes a plurality of vanes that are mounted on the base member of the plate. Structurally, these vanes extend between the base member of the airflow deflector plate and the chin portion of the helmet body, to thereby establish a plurality of airways in the deflector plate. Further, the vanes are angled, relative to a common centerline that is defined by the deflector plate. Thus, the angled vanes establish the airflow pattern over the inside surface of the lens, as described above.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
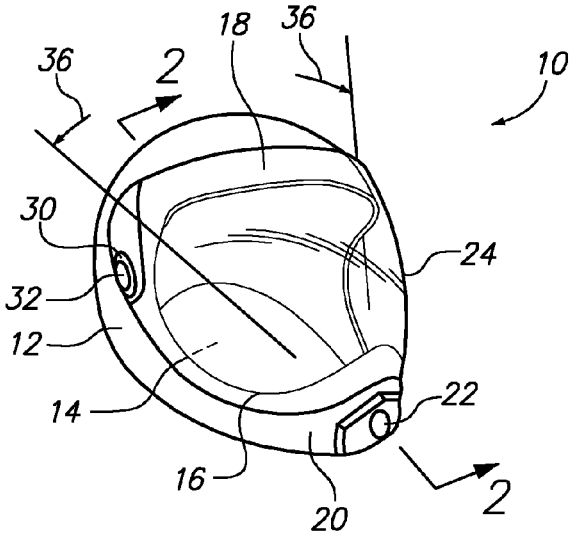
FIG. 1 is a perspective view of a skydiving helmet in accordance with the present invention.

Referring initially to FIG. 1, a skydiving helmet in accordance with the present invention is shown and is generally designated 10. As shown, the skydiving helmet 10 includes a helmet body 12 which is formed with an opening 14, that is surrounded by a rim 16. Further, the helmet body 12 includes a forehead portion 18 and a chin portion 20 that are opposite from each other, across the opening 14. The chin portion 20 of the helmet body 12 is formed with an air-intake hole 22.

Figure 2:
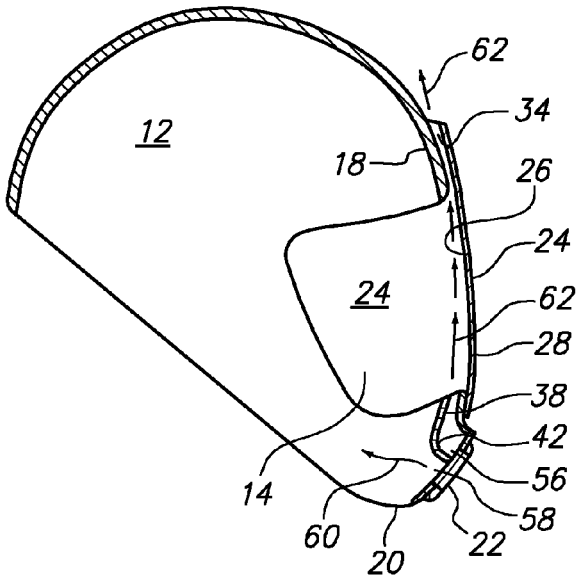
FIG. 2 is a cross sectional view of the skydiving helmet as seen along the line 2-2 in FIG. 1.

Still referring to FIG. 1, the helmet 10 is shown to include a transparent lens 24 that is covering the opening 14 of the helmet body 12. Referring for the moment to FIG. 2, it is seen that the lens 24 has an inside surface 26 and an outside surface 28. For purposes of the present invention, the transparent lens 24 may be either clear or tinted. Further, referring back to FIG. 1, it will also be seen that the lens 24 is mounted onto the helmet body 12 with a swivel mount 30. It is to be appreciated that another swivel mount 30 (not shown) is located on the other side of the helmet body 12. This other swivel mount 30 will thus be opposite and across the opening 14 from the swivel mount 30 that is shown in FIG. 1. As an added feature, the lens 24 can be positioned on the helmet body 12 using a so-called "quick connect" system. Further, as envisioned for the present invention, each of the above-mentioned swivel mounts 30 can be manipulated by a respective release button 32 to swivel the lens 24 on the helmet body 12. In particular, this swiveling occurs between a closed position (shown in FIGS. 1 and 2) and an open position (not shown). More specifically, in the open position, the lens 24 is still supported by the swivel mounts 30, but it is lifted from the opening 14 to provide for access through the opening 14 and into the helmet 10.

An important structural aspect for the skydiving helmet 10 of the present invention is an exhaust vent 34. In FIG. 2, this exhaust vent 34 is shown to be created between the lens 24 and the forehead portion 18 of the helmet body 12 when the lens 24 is in its closed position (shown in FIG. 2). More specifically, the exhaust vent 34 will extend through an arc 36 that is centered on the air-intake hole 22. Importantly, this arc 36 will effectively overlie the nose and eyes of the skydiver (not shown). To do this, the arc 36 will preferably be about 100°.

Figure 3:
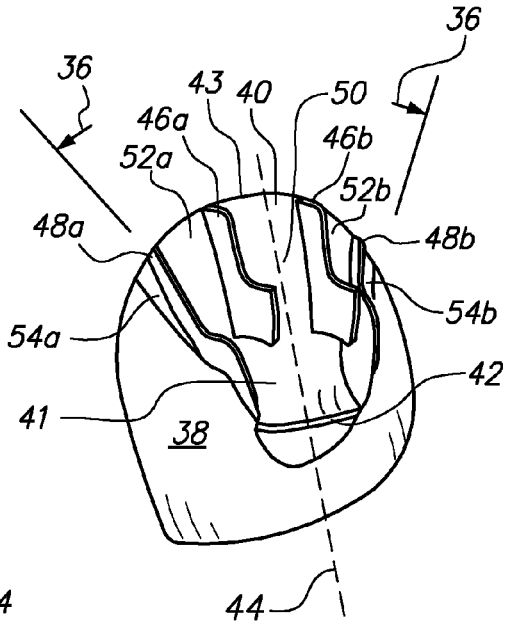
FIG. 3 is a perspective view of an air deflector plate as used for the skydiving helmet of the present invention.

A deflector plate 38 is shown in FIG. 3. As shown, the deflector plate 38 includes a base member 40, having a first end 41 and a second end 43, that is formed with a scoop 42 at the first end 41, and the deflector plate 38 defines a centerline 44. A pair of lateral vanes 46*a* and 46*b* extend from the base member 40 to straddle the centerline 44, as do a pair of side vanes 48*a* and 48*b*. The lateral vanes 46*a* and 46*b*, as well as the side vanes 48*a* and 48*b* are all angled on the deflector plate 38 relative to the centerline 44. Together, these lateral vanes 46*a* and 46*b* and side vanes 48*a* and 48*b* are oriented to establish a plurality of airways. Specifically, a central airway 50 is established between the lateral vanes 46*a* and 46*b*. Additionally, a pair of lateral airways 52*a* and 52*b* is established by the deflector plate 38. In this case, the lateral airways 52*a* and 52*b* are each on opposite sides of the central airway 50. Structurally, lateral airway 52*a* is established between lateral vane 46*a* and side vane 48*a*. And, lateral airway 52*b* is established between lateral vane 46*b* and side vane 48*b*. Also, a side airway 54*a* is established on the deflector plate 38 by side vane 48*a*. As shown, this side airway 54*a* is located outside the side vane 48*a* and is separated from the lateral airway 52*a* by the side vane 48*a*. Similarly, a side airway 54*b* is established by the side vane 48*b*.

Returning to FIG. 2, it will be appreciated that the deflector plate 38 is positioned inside the helmet body 12 and against its chin portion 20. More specifically, as so positioned, the scoop 42 of the deflector plate 38 effectively divides the air-intake hole 22 into an upper air-intake vent 56 and a lower air-intake vent 58. With this structure, breathing air is directed into the helmet 10 (see arrow 60) through the lower air-intake vent 58, for use by the skydiver. On the other hand, anti-fog air entering the helmet 10 through the upper air-intake vent 56 (see arrows 62) is directed by the deflector plate 38 against the inside surface 26 of the lens 24. As envisioned for the present invention, the anti-fog air (see arrows 62) is directed by the deflector plate 38 across the arc 36, and against the inside surface 26 for exit from the helmet 10 through the exhaust vent 34.

While the particular Skydiving Helmet with Anti-Fog System as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A skydiving helmet with a fog prevention feature which comprises:

a helmet body formed with an opening bordered by a helmet rim of the helmet body, wherein the helmet rim is dimensioned to surround the face of a skydiver, and wherein the helmet rim has a forehead portion and a chin portion, with the chin portion being formed with an air-intake hole;

a transparent lens, having an inside surface and an outside surface, wherein the lens is mounted on the helmet body to cover the opening, and to separate the inside surface of the lens from the forehead portion of the rim to create an exhaust vent therebetween extending through an arc centered on the air-intake hole of the chin portion;

an airflow deflector plate positioned against the air-intake hole to establish an air-intake vent with the deflector plate defining a centerline bisecting the deflector plate and extending between the air-intake hole and the arc of the exhaust vent;

a pair of side vanes formed on the deflector plate to straddle the centerline, wherein the side vanes are angled relative to the centerline to widen toward the exhaust vent with an angle therebetween less than the arc of the exhaust vent; and a pair of lateral vanes formed on the deflector plate and angled with the side vanes relative to the centerline wherein the lateral vanes are positioned respectively between a side vane and the centerline to create a plurality of airways oriented on the deflector plate to direct air into the helmet and over the inside surface of the lens from the air-intake hole to the arc at the exhaust vent to prevent fog from forming on the inside surface during a skydive by the skydiver.

2. A skydiving helmet as recited in claim 1 wherein the airflow deflector plate further comprises:

a base member having a first end and a second end;

a scoop formed at the first end of the base member, wherein the scoop is positioned across the air-intake hole to establish an upper air-intake vent and a lower air-intake vent, and wherein the plurality of vanes is mounted on the base member to extend between the base member and the chin portion of the helmet body to create the plurality of airways in the upper air-intake vent for moving air from the air-intake hole and into the helmet body.

3. A skydiving helmet as recited in claim 1 wherein the exhaust vent extends through an arc of 100°.

4. A skydiving helmet as recited in claim 1 wherein the exhaust vent has a separation distance of ⅛ inch between the inside surface of the lens and the forehead portion of the rim.

5. A skydiving helmet as recited in claim 1 further comprising:

a pair of swivel mounts positioned opposite each other on the helmet for engagement with the lens, to allow for a lifting movement of the lens away from the opening to permit access into the helmet body through the opening; and a pair of release buttons, with each release button being connected with a respective swivel mount to selectively hold the lens in place on the helmet body to surround the face of the skydiver.

6. A skydiving helmet as recited in claim 1 wherein the lens is made of a clear plastic material and is mounted on the helmet body using a quick connect.

7. A skydiving helmet as recited in claim 1 wherein the airflow deflector plate is glued onto the chin portion of the helmet rim.

8. A skydiving helmet with a fog prevention feature which comprises:

a helmet body formed with an air-intake hole;

a transparent lens mounted on the helmet body to protect the face of a skydiver, wherein the lens has an inside surface and an outside surface;

an exhaust vent created by a separation distance between the helmet body and the inside surface of the lens, wherein the exhaust vent is located across the lens and opposite the air-intake hole, and wherein the exhaust vent extends through an arc centered on the air-intake hole to draw air from the air-intake hole over the inside surface of the lens to prevent fog on the lens during a skydiving event; and an airflow deflector plate affixed to the helmet body for deflecting air into the helmet from the air-intake hole, the airflow deflector plate defining a centerline bisecting the deflector plate and extending between the air-intake hole and the arc of the exhaust vent with a pair of side vanes formed on the deflector plate to straddle the centerline, wherein the side vanes are angled relative to the centerline to widen toward the exhaust vent with an angle therebetween less than the arc of the exhaust vent and a pair of lateral vanes formed on the deflector plate and angled with the side vanes relative to the centerline wherein the lateral vanes are positioned respectively between a side vane and the centerline to create a plurality of airways oriented on the deflector plate for directing the deflected air against the inside surface of the lens during a skydiving event.

9. A skydiving helmet as recited in claim 8 wherein the helmet body is formed with an opening bordered by a helmet rim of the helmet body, wherein the helmet rim is dimensioned to surround the face of a skydiver, and wherein the helmet rim has a forehead portion and a chin portion, with the chin portion being formed with the air-intake hole.

10. A skydiving helmet as recited in claim 9 wherein the airflow deflector plate is glued onto the chin portion of the helmet rim.

11. A skydiving helmet as recited in claim 8 wherein the airflow deflector plate further comprises:

a base member having a first end and a second end;

a scoop formed at the first end of the base member, wherein the scoop is positioned across the air-intake hole to establish an upper air-intake vent and a lower air-intake vent, and wherein the plurality of vanes is mounted on the base member to extend between the base member and the chin portion of the helmet body to create the plurality of airways in the upper air-intake vent for moving air from the air-intake hole and into the helmet body.

12. A skydiving helmet as recited in claim 8 wherein the separation distance is ⅛ inch.

13. A skydiving helmet as recited in claim 8 further comprising:

a pair of swivel mounts positioned opposite each other on the helmet for engagement with the lens, to allow for a lifting movement of the lens away from the opening to permit access into the helmet body through the opening; and a pair of release buttons, with each release button being connected with a respective swivel mount to selectively hold the lens in place on the helmet body to surround the face of the skydiver.

14. A skydiving helmet as recited in claim 8 wherein the lens is made of a clear plastic material.

15. A method for manufacturing a skydiving helmet with a fog prevention feature which comprises the steps of:

providing a helmet body formed with an opening bordered by a helmet rim of the helmet body, wherein the helmet rim is dimensioned to surround the face of a skydiver, and wherein the helmet rim has a forehead portion and a chin portion, with the chin portion being formed with an air-intake hole;

mounting a transparent lens on the helmet body, wherein the lens has an inside surface and an outside surface, and is mounted on the helmet body to cover the opening to separate the inside surface of the lens from the forehead portion of the rim and to create an exhaust vent therebetween extending through an arc centered on the air-intake hole of the chin portion; and positioning an airflow deflector plate against the air-intake hole to establish an air-intake vent, the airflow deflector plate defining a centerline bisecting the deflector plate and extending between the air-intake hole and the arc of the exhaust vent with a pair of side vanes formed on the deflector plate to straddle the centerline, wherein the side vanes are angled relative to the centerline to widen toward the exhaust vent with an angle therebetween less than the arc of the exhaust vent and a pair of lateral vanes formed on the deflector plate and angled with the side vanes relative to the centerline wherein the lateral vanes are positioned respectively between a side vane and the centerline to create a plurality of airways oriented on the deflector plate to direct air into the helmet and over the inside surface of the lens from the air-intake hole to the exhaust vent, wherein the air deflector plate includes a base member with a scoop formed thereon and positioned across the air-intake hole to establish an upper air-intake vent and a lower air-intake vent, and with the plurality of vanes mounted on the base member to extend between the base member and the chin portion of the helmet body to create the plurality of airways in the upper air-intake vent for moving air from the air-intake hole and into the helmet body to prevent fog from forming on the inside surface during a skydive by the skydiver.

16. A method as recited in claim 15 wherein the exhaust vent extends through an arc of 100°, and wherein the exhaust vent has a separation distance of ⅛ inch between the inside surface of the lens and the forehead portion of the rim.

* * * * *